US006695201B2

(12) United States Patent
Narasipura et al.

(10) Patent No.: US 6,695,201 B2
(45) Date of Patent: Feb. 24, 2004

(54) STRESS RELIEVED LOWER SHELL FOR SEALED COMPRESSORS

(75) Inventors: Sudarshan K. Narasipura, Arkadelphia, AR (US); Gregory W. Hahn, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 174 days.

(21) Appl. No.: 09/938,165

(22) Filed: Aug. 23, 2001

(65) Prior Publication Data

US 2003/0039562 A1 Feb. 27, 2003

(51) Int. Cl.[7] ..... B23K 35/12; B23K 31/02; B23K 28/00; F04C 2/00

(52) U.S. Cl. ..... 228/245; 228/227; 228/199; 228/203; 148/320; 418/55.1

(58) Field of Search ..... 228/245, 227, 228/199, 203; 148/320; 418/55.1

(56) References Cited

U.S. PATENT DOCUMENTS

| | | | | | |
|---|---|---|---|---|---|
| 4,850,187 | A | * | 7/1989 | Siga et al. | 60/39.37 |
| 5,219,281 | A | * | 6/1993 | Caillat et al. | 418/55.6 |
| 6,110,299 | A | * | 8/2000 | Tosaka et al. | 148/320 |
| 6,247,909 | B1 | * | 6/2001 | Williams et al. | 418/55.1 |
| 6,428,292 | B1 | * | 8/2002 | Wallis et al. | 418/55.1 |
| 6,531,005 | B1 | * | 3/2003 | Bezerra et al. | 148/516 |
| 2002/0047391 | A1 | * | 4/2002 | Nakamura et al. | 310/90 |
| 2002/0062885 | A1 | * | 5/2002 | Li | 148/311 |

FOREIGN PATENT DOCUMENTS

EP 1207005 A1 * 5/2002

* cited by examiner

*Primary Examiner*—L. Edmondson
(74) *Attorney, Agent, or Firm*—Carlson, Gaskey & Olds

(57) ABSTRACT

A lower shell for a sealed compressor includes a shape with a plurality of intricate bends. In particular, u-shaped sections are stamped into a plainer sheet of material to form the lower shell. This stamping process can cause brittleness in the lower shell. Thus, after the stamping process, the lower shell is subjected to a heat-treating process to reduce the brittleness. After the heat-treating process a center shell is welded to the lower shell.

6 Claims, 3 Drawing Sheets

STRESS RELIEVED LOWER SHELL FOR SEALED COMPRESSORS

BACKGROUND OF THE INVENTION

This invention relates to a process for strengthening the lower shell of a sealed compressor housing.

Refrigerant compressors typically include a compressor pump driven by a motor within a sealed housing. In such compressors, the refrigerant is allowed to flow over the motor driving the compressor pump to cool the motor during operation. Therefore the sealed housing must provide a fluid tight seal. Most housings are constructed from upper and lower shells attached to corresponding ends of a center cylindrical shell. The motor and compressor are secured within the center shell.

One common type of compressor used for commercial and residential refrigeration applications is a scroll compressor. A scroll compressor operates by trapping refrigerant within compression chambers formed between interfitting scrolls. Each scroll has a generally spiral wrap extending from a base. Typically one of the scrolls is an orbiting scroll and the other is non-orbiting. The motor drives the orbiting scroll relative to the non-orbiting scroll to progressively reduce the volume of the compression chambers, thereby compressing the refrigerant.

In one recently developed lower shell, a guide portion engages an inner part of the center shell to align the two pieces. The guide portion has a u-shaped section formed in the lower shell. The guide portion of the lower section is typically formed from a cold forming process such as stamping. The stamping process introduces stresses into the lower shell that increases the brittleness of the material in sections having the most intricate shapes. The increase in brittleness corresponds to a reduction in material elongation properties caused by cold work hardening of the stamping process. Further, the center shell is attached to the lower shell by a welding process that creates heat-affected zones that further hardens the material.

Currently pending patent application Ser. No. 09/816,178 titled "Weld Strengthening Component for Sealed Compressors" assigned to the applicant includes the addition of a strengthening member to the u-shaped section in order to increase the static pressure level that can be held by the sealed compressor. Such a method improves the static pressure capability of the sealed housing, however, it would be desirable to further increase this capability. Further, the addition of the strengthening member requires additional parts and manufacturing steps that may be undesirable in the cost conscious production environment.

Thus it would be desirable to strengthen the lower shell and particularly any region with dramatic and acute shapes such as the above-described u-shaped sections without additional parts.

SUMMARY OF THE INVENTION

A disclosed embodiment of this invention is a sealed compressor housing with a heat-treated lower shell that increases the capability of the sealed housing to withstand high static pressures.

The heat-treated lower shell is attached by a welding operation to a center shell. The lower shell of the subject compressor is heat treated to relieve stresses built up from previous processes. In the preferred embodiment the lower shell includes a u-shaped bend that is formed by a stamping process. The stamping process cold works the part and creates regions or zones of increased hardness. As the hardness of the material is increased the capability of the material to expand is decreased. This capability is related to elongation properties of the material.

The cold working process introduces high stress areas particularly in regions with the most dramatic changes in shape such as in the u-shaped guide section of the lower shell. Heat treatment of the lower shell relieves stress in the material and restores the materials elongation properties to a level substantially that of the original material. Heat-treating of the lower shell before the welding process restores the material to substantially the original elongation properties of the material such that stresses introduced by the welding process do not change the elongation properties of the material to the magnitude of the combined process without heat treat.

This invention provides a lower shell with improved material properties such that the static pressure capability of the sealed housing is significantly improved without additional parts or expensive additional manufacturing process.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
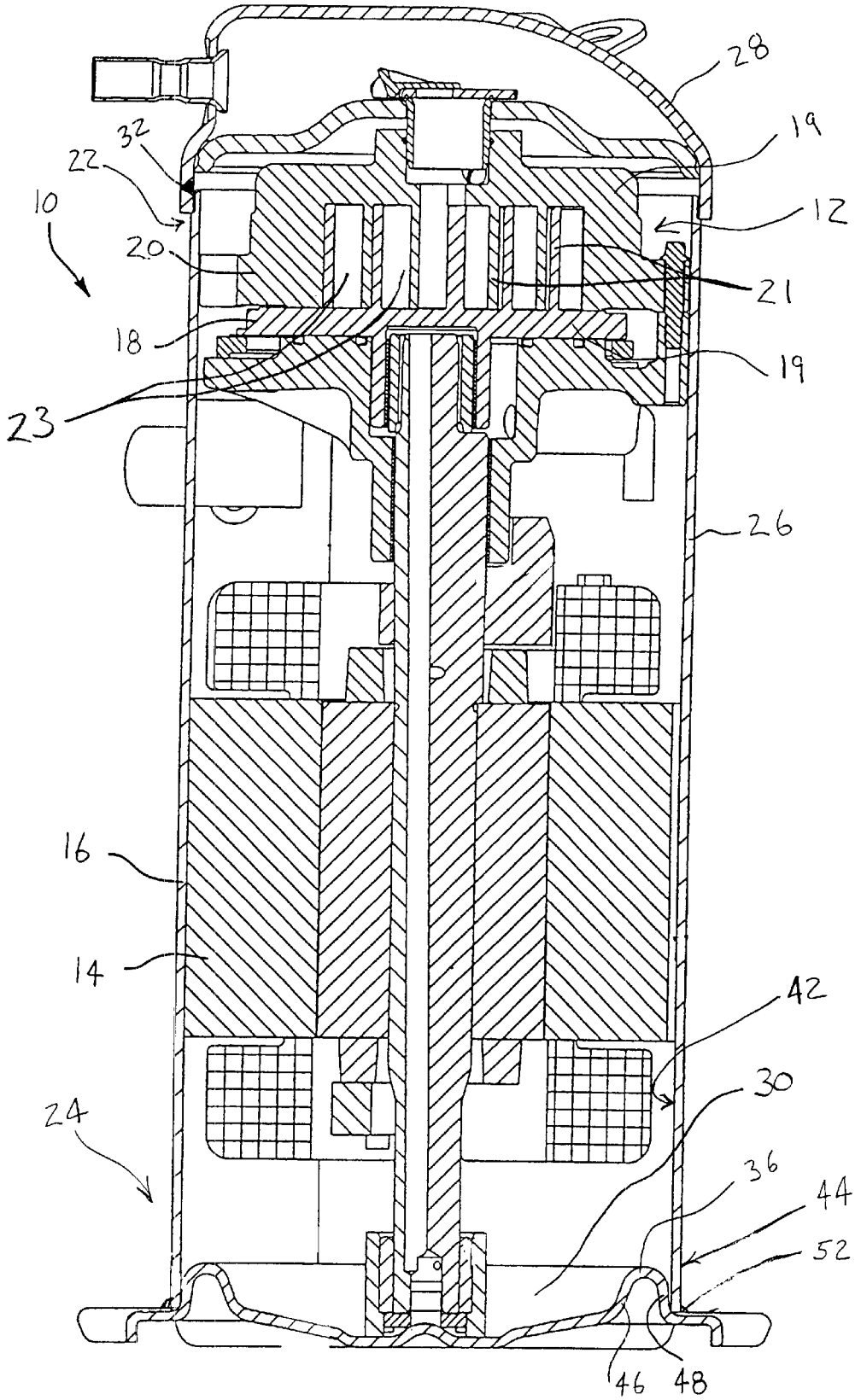
FIG. 1 is cross sectional view of a compressor.

Referring to the Figures, wherein like numerals indicate like or corresponding parts throughout the several views, the subject invention is a sealed compressor assembly generally shown at 10 in FIG. 1. The sealed compressor 10 includes a compressor 12 and motor 14 disposed within a sealed housing 16. The compressor 12 is preferably a scroll type compressor. The scroll compressor includes an orbiting 18 and a non-orbiting scroll 20. The sealed housing 16 includes a center shell 26 with first and second ends 22, 24. The compressor 12 is disposed near the first end 22 of the center shell 26 and the motor 14 is disposed closer to the second end 24 of the center shell 26. The scrolls 18, 20 include generally spiral wraps 21 extending from a base 19. The spiral wraps 21 interfit to form compression chambers 23. The motor 14 drives the orbiting scroll 18 relative to the non-orbiting scroll 20 to progressively compress a refrigerant within the compression chambers 23. It is understood by those skilled in the art that a scroll compressor is only one type of compressor that would benefit from the application of this invention and that other types of sealed compressors fall within the scope of this invention. An upper shell 28 is attached to the first end 22 of the center shell 26 and a lower shell 30 is attached to the second end 24.

Figure 2:
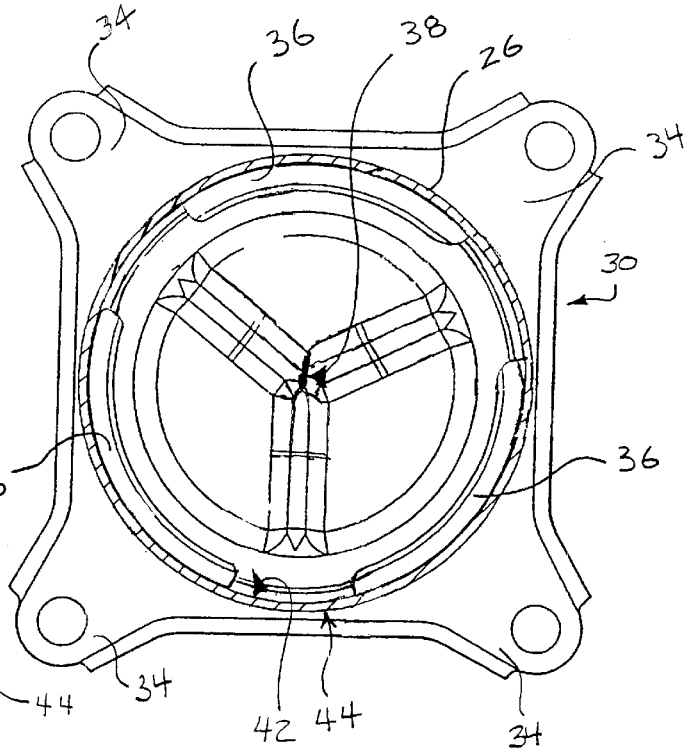
FIG. 2 is a plane view of the lower shell with discrete guide sections.

Referring to FIG. 2, the lower shell 30 is a generally square shaped plate with legs 34 extending from each corner.

The lower shell also includes additional features that provide guiding and support functions for the motor and compressor. Preferably these features are formed from a stamping process as explained below. In the preferred embodiment the compressor 10 is of an upright configuration and the legs 34 provide stability and mounting points. Although the application illustrates an upright compressor 34 it should be understood that other configurations of a sealed compressor are within the contemplation of the invention, such as a horizontally disposed compressor.

The lower shell 30 includes guide sections 36 that align with an inner diameter 42 of the center shell 26. The guide sections 36 extend upward from the lower shell about a central point 38 of the lower shell 30 at a radius such that the inner diameter 42 of the center shell 26 fits to the outside of each of the guide sections 36. The guide sections 36 are equally spaced at intervals about the central point 38.

Figure 3:
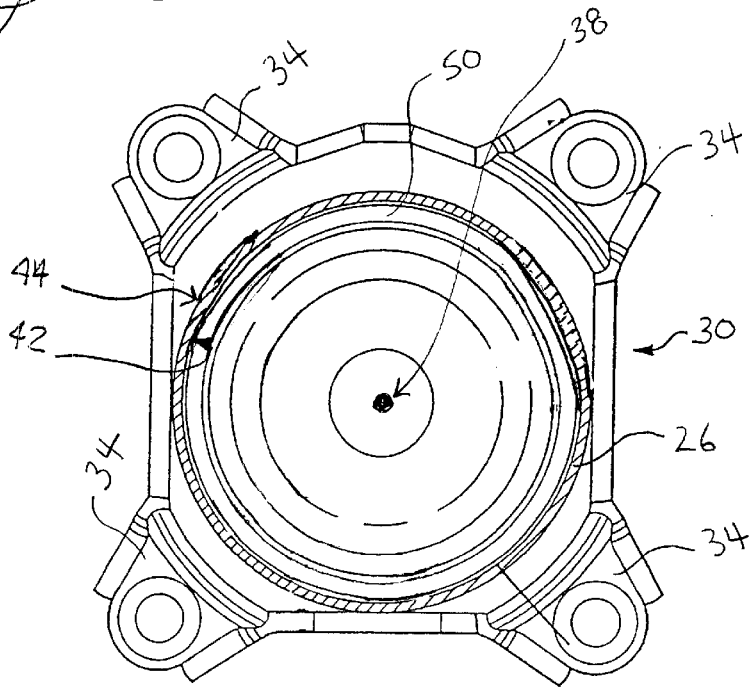
FIG. 3 is a plan view of the lower shell with a continuous guide section.

Referring to FIG. 3, another embodiment of the lower shell includes a guide section 50 that extends uninterrupted about the central point 38. A worker knowledgeable in the art would understand that other configurations of the guide sections 36, 50 are possible and are within the scope of the subject invention.

Figure 4:
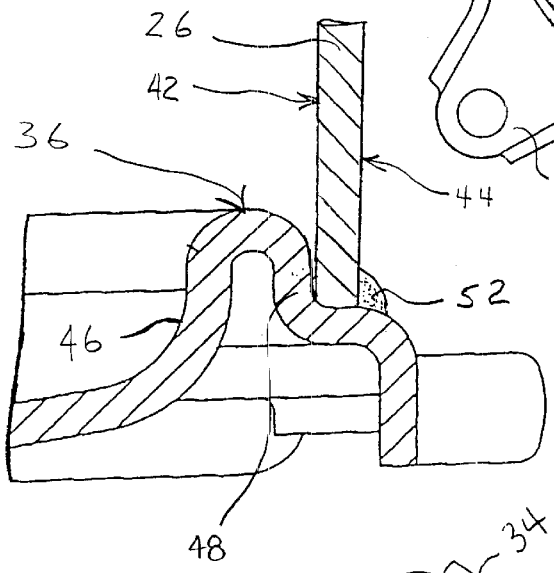
FIG. 4 is a cross-sectional view of the joint between the lower shell and the center shell.

Referring to FIG. 4, fabrication of the sealed housing 12 includes placing the central shell 26 onto the lower shell 30 with the guide sections 36 abutting the inner diameter 42 of the central shell 26. The lower shell 30 is attached to the center shell 26 by a weld 52 between the outer diameter 44 of the center shell 26 and the lower shell 30. The cross-section of the guide section 36 is generally u-shaped having an inner leg 46 and an outer leg 48. A worker skilled in the art would understand that the specific cross-sectional shapes of the guide sections 36 are application sensitive and many variations are possible within the scope of this invention. Further, for purposes of this application, the term "u-shaped" should be taken as a general descriptive term of a shape having two legs with a center section connecting the two legs. Although the shape is generally shown as being generally symmetrical, in practice, the shape will typically vary from such a symmetric shape.

The guide sections 36, 50 are preferably formed from a stamping process that cold works the material. As the material is hardened the elongation properties of the material are reduced such that the capability of the material to expand under pressure is impaired. The reduced ability to expand under pressure correlates to a reduction in the amount of static pressure that the sealed housing 12 can withstand. The cold work hardening of the material is the result of stresses introduced during the stamping process. Stresses from cold working hardening of the material are of the greatest concern where the shape of the lower shell 30 magnifies the affects of pressure within the sealed housing 16, such as at the extreme bends of the u-shaped guide section 36,50.

The welding process used to attach the lower shell 30 to the center shell 26 further contributes to weakening the material and thereby reducing the magnitude of static pressure that the sealed housing can withstand. The weld between the center shell and the lower shell creates heat-affected zones within the guide sections 36 and the center shell 26 that further reduces the elongation properties of the material used to fabricate the sealed housing 16. Heat treatment of the lower shell 30 prior to attachment to the center shell 26 restores the original elongation properties of the material.

Figure 5:
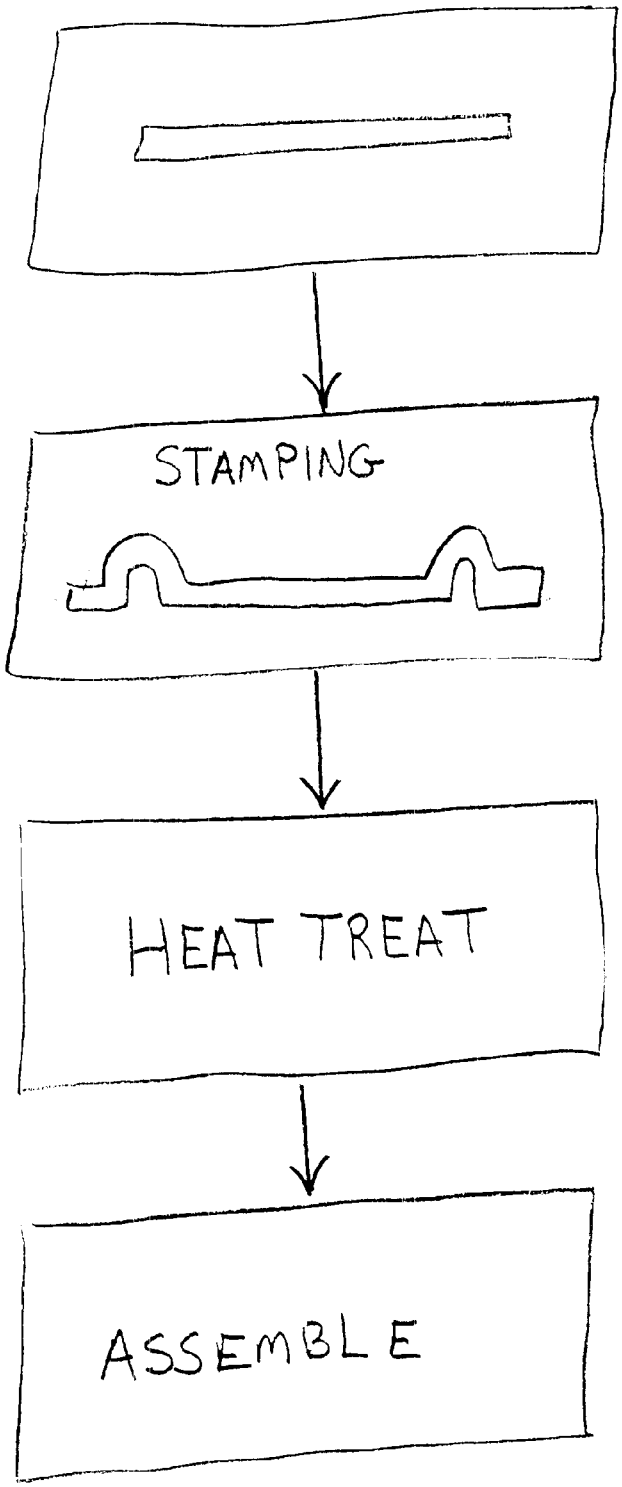
FIG. 5 schematically shows a process for manufacturing and assembling the lower shell of a sealed compressor housing.

It is shown in FIG. 5, a method of arriving at the final lower shell 30 includes starting with a generally flat sheet of metal. This sheet has been stamped to have the u-shaped sections. A heat-treating process, as what we describe below next occurs. Once this is complete, the lower shell maybe assembled to the center shell by a welding process as described above.

The heat treat process applied to the lower shell relieves the stress built up in the material. The heat treat process includes soaking the lower shell at a temperature between 1000 and 1050 degrees Fahrenheit (F.) for approximately one hour. After the one-hour soak of the lower shell 30 the temperature is ramped down to 500 degrees F. Upon reaching 500 degrees F., the lower shell 30 is air cooled at an ambient temperature. After this heat treat process is complete, the elongation properties of the material are restored to approximately that of the original material before the stamping process. Preferably the material is common grade steel, the specific temperatures and duration of the heat treat process will differ dependent on the type and grade of material used and the amount of cold work hardening introduced into the material from the stamping process. A worker knowledgeable in the art would understand that other temperatures and durations may be used and would fall within the scope of this invention.

The end effect of the heat-treat processes it to substantially restore the original elongation properties of the lower shell 30 prior to the stamping process. The construction of the sealed housing requires the weld 52 between the center shell 26 and the lower shell 30. Heat-treating of the lower shell 30 prior to the welding process restores the material to substantially the original elongation properties such that stresses introduced by the welding process do not change the elongation properties of the material to the magnitude of the combined process without heat treat. Therefore the static pressure that the sealed housing 16 can withstand is significantly improved.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. It is understood that within the scope of the appended claims, the invention may be practiced otherwise than as specifically described. For that reason the following claims should be studied to determine the true scope and content of this invention.

What is claimed is:

1. A method of producing a sealed compressor comprising the steps of:

a) providing a center shell and at least a lower shell, the step of providing at least said lower shell including the subset starting with a more planar sheet of steel, and stamping said more-planar sheet of steel into a less planar shape;

b) heat treating said lower shell; and c) welding said lower shell to said center shell after steps a and b.

2. A method as set forth in claim 1, wherein the non-plainer shape of the lower shell includes generally u-shaped sections formed by said stamping step.

3. The method of claim 2, wherein said step b is further defined by soaking said lower shell at a first temperature for a predetermined amount of time.

4. The method of claim 3, wherein said step b is further defined by lowering the temperature of said lower shell from said first temperature to a second temperature lower than said first temperature, then cooling said lower shell in air at ambient temperature.

5. The method of claim 4, wherein said predetermined time is approximately one hour.

6. The method of claim 4, wherein said first temperature is between 1000 and 1050 degrees Fahrenheit and said second temperature is 500 degrees Fahrenheit.

* * * * *

UNITED STATES PATENT AND TRADEMARK OFFICE

CERTIFICATE OF CORRECTION

PATENT NO. : 6,695,201 B2
DATED : February 24, 2004
INVENTOR(S) : Narasipura et al.

It is certified that error appears in the above-identified patent and that said Letters Patent is hereby corrected as shown below:

Column 4,
Lines 52, 53 and 54, “planar” should read as -- plainer --.

Signed and Sealed this

First Day of June, 2004

JON W. DUDAS
*Acting Director of the United States Patent and Trademark Office*